US007333059B2

(12) United States Patent
Li et al.

(10) Patent No.: US 7,333,059 B2
(45) Date of Patent: Feb. 19, 2008

(54) COMPACT CIRCULARLY-POLARIZED PATCH ANTENNA

(75) Inventors: Qian Li, Ann Arbor, MI (US); Wladimiro Villarroel, Worthington, OH (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 188 days.

(21) Appl. No.: 11/190,445

(22) Filed: Jul. 27, 2005

(65) Prior Publication Data

US 2007/0024511 A1 Feb. 1, 2007

(51) Int. Cl.
*H01Q 1/38* (2006.01)

(52) U.S. Cl. ..... 343/700 MS; 343/713

(58) Field of Classification Search ..... 343/700 MS, 343/713, 846

See application file for complete search history.

(56) References Cited

U.S. PATENT DOCUMENTS

| | | | | |
|---|---|---|---|---|
| 4,500,887 A | | 2/1985 | Nester | |
| 4,575,725 A | * | 3/1986 | Tresselt | 343/700 MS |
| 4,823,145 A | | 4/1989 | Mayes et al. | |
| 4,843,403 A | | 6/1989 | Lalezari et al. | |
| 5,036,335 A | | 7/1991 | Jairam | |
| 5,081,466 A | | 1/1992 | Bitter, Jr. | |
| 5,270,722 A | * | 12/1993 | Delestre | 343/700 MS |
| 5,410,323 A | | 4/1995 | Kuroda | |
| 5,519,408 A | | 5/1996 | Schnetzer | |
| 5,541,611 A | | 7/1996 | Peng et al. | |
| 5,568,159 A | | 10/1996 | Pelton et al. | |
| 5,734,350 A | | 3/1998 | Deming et al. | |
| 6,054,961 A | * | 4/2000 | Gong et al. | 343/713 |
| 6,191,750 B1 | | 2/2001 | Bonebright | |
| 6,278,410 B1 | | 8/2001 | Soliman et al. | |
| 6,392,599 B1 | | 5/2002 | Ganeshmoorthy et al. | |
| 6,496,155 B1 | | 12/2002 | Sievenpiper et al. | |

(Continued)

FOREIGN PATENT DOCUMENTS

| | | |
|---|---|---|
| EP | 0993069 A2 | 12/2000 |
| EP | 1362614 A1 | 11/2003 |

OTHER PUBLICATIONS

"Dual Frequency Circularly-Polarized Proximity-Fed Microstrip Antenna", A Hoorfar et al., Electronics Letters, May 13, 1999, vol. 35, No. 10, pp. 759-761.

(Continued)

*Primary Examiner*—Michael C. Wimer
(74) *Attorney, Agent, or Firm*—Howard & Howard Attorneys, P.C.

(57) ABSTRACT

An antenna for receiving and/or transmitting circularly polarized RF signals includes a patch element, a ground plane, a dielectric, and a feed line. The patch element is disposed on a pane of glass and includes a pair of radiating sides disposed opposite each other and a pair of spacer sides disposed opposite each other. The radiating sides form an angle less than 90 degrees with the spacer sides. A first axis is defined through a center of the radiating sides and a second axis defined though a center of the spacer sides. The ground plane is disposed substantially parallel to and spaced from the patch element. The dielectric substrate is sandwiched between the patch element and the ground plane. The feed line is disposed substantially parallel to and offset from the first axis for providing the antenna with a circular polarization radiation characteristic. The antenna is compact in size and generally conformal to the pane of glass.

40 Claims, 9 Drawing Sheets

U.S. PATENT DOCUMENTS

| | | | |
|---|---|---|---|
| 6,518,931 | B1 | 2/2003 | Sievenpiper |
| 6,664,932 | B2 | 12/2003 | Sabel et al. |
| 6,717,548 | B2 | 4/2004 | Chen |
| 6,747,602 | B2 | 6/2004 | Matsuoka et al. |
| 6,762,728 | B2 | 7/2004 | Koyama et al. |
| 2001/0050638 | A1 | 12/2001 | Ishitobi et al. |
| 2002/0175879 | A1 | 11/2002 | Sabel et al. |
| 2004/0100408 | A1 | 5/2004 | Okado |
| 2004/0100409 | A1 | 5/2004 | Okado |
| 2004/0169609 | A1 | 9/2004 | Song et al. |

OTHER PUBLICATIONS

"Suspended Patch Antennas With Electromagnetically Coupled Inverted Microstrip Feed For Circular Polarization", Rainee N. Simons, Antennas and Propagation Society International Symposium, 2000. IEEE Jul. 16-21, 2000, Piscataway, NJ, USA, IEEE, vol. 2, Jul. 16, 2000, pp. 992-995.

"A Circularly Polarized Rectangular Microstrip Antenna Using Single-Fed Proximity-Coupled Method" IEEE Transaction On Antennas And Propagation, IEEE Service Center, Piscataway, NJ, US, vol. 43, No. 8, Aug. 1, 1995, pp. 895-896.

"Theoretical And Experimental Analysis Of A Circularly Polarized Notched Antenna Fed Electromagnetically By One Microstrip Line", H. Legay et al., Laboratoire Structure rayonnantes, U.A. au C.N.R.S. No. 834, IEEE, 1990, pp. 644-647.

* cited by examiner

COMPACT CIRCULARLY-POLARIZED PATCH ANTENNA

BACKGROUND OF THE INVENTION

1. Field of the Invention

The subject invention relates to an antenna, specifically a microstrip patch antenna, for receiving a circularly polarized radio frequency (RF) signal from a satellite.

2. Description of the Prior Art

Patch antennas for receiving RF signals are well known in the art. One example of such an antenna is disclosed in United States Patent Application Publication No. 2001/0050638 (the '638 publication) to Ishitobi et al. The antenna of the '638 publication includes a patch element. The patch element includes a pair of curved sides disposed opposite from each other and defining inward a pair of curved voids. The patch element also includes a pair of straight sides disposed opposite from each other. A first axis is defined through a center of the curved sides and a second axis is defined through a center of the straight sides. The patch element is symmetrical about each axis. A ground plane is disposed substantially parallel to and spaced from the patch element. The patch element and ground plane sandwich a dielectric. A terminal is connected to the patch element at a point along the second axis for electrically coupling RF signals to/from the patch element. A transmission line is directly connectable to the terminal for electrically connecting the antenna to an amplifier. However, the antenna disclosed in the '638 publication does not receive circularly polarized RF signals.

Vehicles have long implemented glass to enclose a cabin of the vehicle while still allowing visibility for the driver of the vehicle. Automotive glass is typically either a tempered (or toughened) glass or a laminated glass which is produced by bonding two or more panes of glass together with a plastic interlayer. The interlayer keeps the panes of glass together even when the glass is broken.

Recently, antennas have been integrated with the glass of the vehicle. This integration helps improve the aerodynamic performance of the vehicle and helps present the vehicle with an aesthetically-pleasing, streamlined appearance. Integration of antennas for receiving linearly polarized RF signals, such as those generated by AM/FM terrestrial broadcast stations, has been the principal focus of the industry. However, that focus is shifting to integrating antennas for receiving RF signals from Satellite Digital Audio Radio Service (SDARS) providers. SDARS providers use satellites to broadcast RF signals, particularly circularly polarized RF signals, back to Earth. SDARS providers use multiple satellites in a geostationary orbit or in an inclined elliptical constellation.

The characteristics of glass, particularly soda-lime-silica automotive glass, and the angled disposition of this glass when applied as a window of a vehicle, provide challenges to the effective integration of an antenna with a window of the vehicle. Automotive manufacturers demand strict requirements as to the amount of visual obstruction caused by antennas integrated with windows of the vehicle. To date, the performance of antennas integrated with automotive glass in receiving SDARS signals has been disappointing. Therefore, there remains an opportunity to introduce an antenna that aids in the reception of the circularly polarized RF signal from a satellite. Particularly, there remains an opportunity for a high-performing antenna that, when integrated with an automotive window, does not create a substantial visual obstruction and still maintains optimal reception of circularly polarized RF signals.

SUMMARY OF THE INVENTION AND ADVANTAGES

The subject invention provides an antenna including a patch element formed of a conductive material. The patch element has a pair of radiating sides disposed opposite each other and a pair of spacer sides disposed opposite each other. A first axis is defined through a center of the radiating sides and a second axis defined though a center of the spacer sides. The antenna also includes a ground plane formed of a conductive material and disposed substantially parallel to and spaced from the patch element. A dielectric is sandwiched between the patch element and the ground plane. A feed line formed of a conductive material is disposed within the dielectric. The feed line is disposed substantially parallel to and offset from the first axis for providing the antenna with a circular polarization radiation characteristic.

The subject invention also provides an antenna including a patch element formed of a conductive material. The patch element includes a pair of radiating sides disposed opposite each other and a pair of spacer sides disposed opposite each other. The radiating sides form an angle less than 90 degrees with the spacer sides. A ground plane formed of a conductive material is disposed substantially parallel to and spaced from the patch element. The antenna also includes a dielectric sandwiched between the patch element and the ground plane.

The structure of the antenna of the subject invention provides excellent performance characteristics when receiving a circularly polarized RF signal. The offset spacing of the feed line from the first axis provides the antenna with a circular polarization radiation characteristic without the need for additional external devices, such as 90° hybrids and the like. Furthermore, the antenna of the subject invention may be integrated with a window of a vehicle. As a result, the antenna is generally conformal with the window and is relatively compact, occupying a relatively small area of the window, yet still providing a high performance when receiving the circularly polarized RF signal. Therefore, the antenna is desirable for automotive manufacturers and a driver of the vehicle.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, an antenna is shown generally at 20. In the illustrated embodiments, the antenna 20 is utilized to receive a circularly polarized radio frequency (RF) signal from a satellite. Those skilled in the art realize that the antenna 20 may also be used to transmit the circularly polarized RF signal. Specifically, the first embodiment of the antenna 20 receives a left-hand circularly polarized (LHCP) RF signal like those produced by a Satellite Digital Audio Radio Service (SDARS) provider, such as XM® Satellite Radio or SIRIUS® Satellite Radio. However, it is to be understood that the antenna 20 may also receive a right-hand circularly polarized (RHCP) RF signal.

Figure 1:
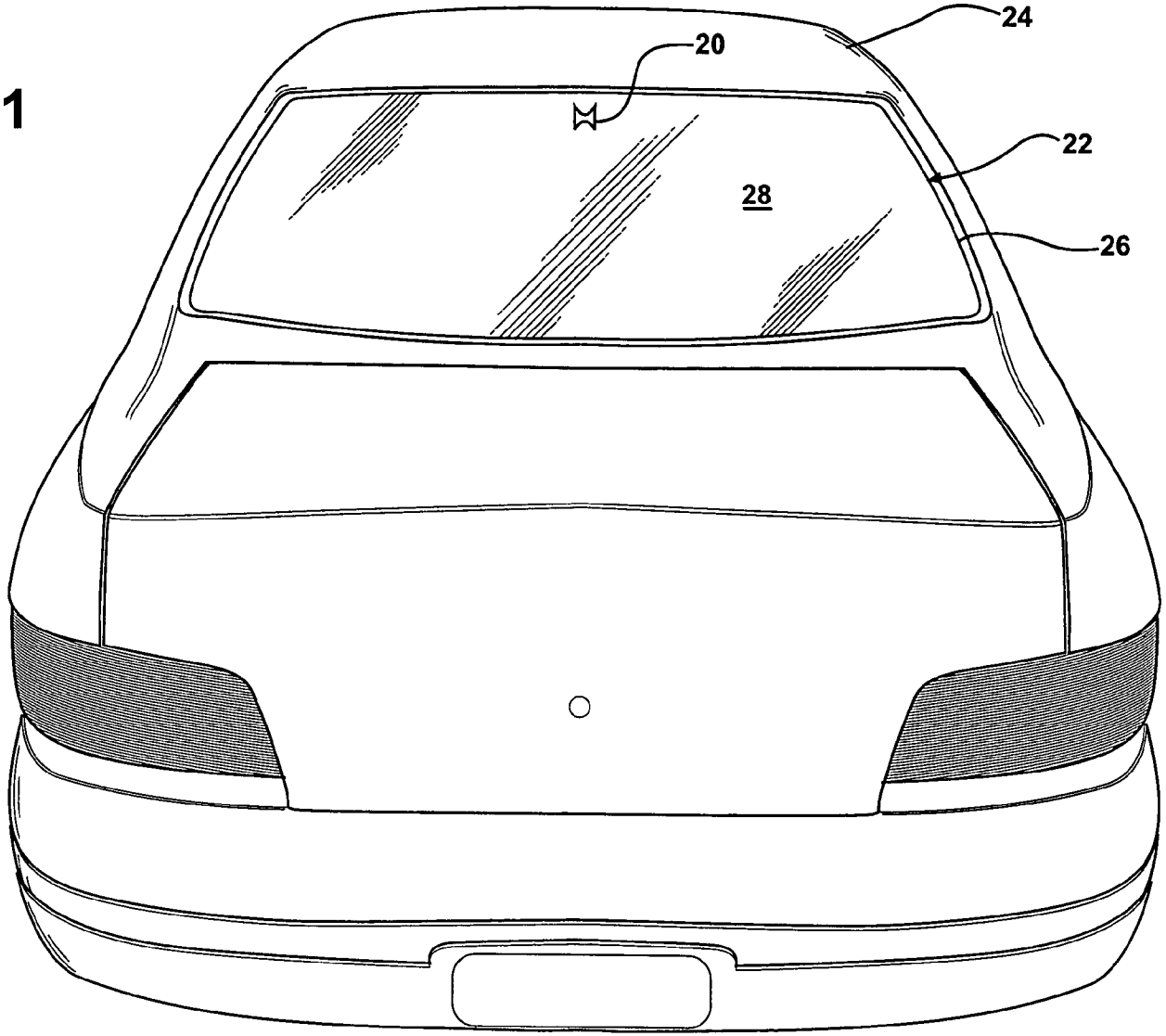
FIG. 1 is a perspective view of a vehicle with an antenna supported by a pane of glass of the vehicle.

Referring to FIG. 1, the antenna 20 is preferably integrated with a window 22 of a vehicle 24. This window 22 may be a rear window 22 (backlite), a front window 22 (windshield), or any other window 22 of the vehicle 24. The antenna 20 may also be implemented in other situations completely separate from the vehicle 24, such as on a building or integrated with a radio receiver. Additionally, the antenna 20 may be disposed on other locations of the vehicle 24, such as on a side mirror. The preferred window 22 includes at least one nonconductive pane 26. The term "nonconductive" refers to a material, such as an insulator or dielectric, that when placed between conductors at different potentials, permits only a small or negligible current in phase with the applied voltage to flow through material. Typically, nonconductive materials have conductivities on the order of nanosiemens/meter.

In the illustrated embodiments, the nonconductive pane 26 is implemented as at least one pane of glass 28. Of course, the window 22 may include more than one pane of glass 28. Those skilled in the art realize that automotive windows 22, particularly windshields, may include two panes of glass sandwiching an adhesive interlayer. The adhesive interlayer may be a layer of polyvinyl butyral (PVB). Of course, another adhesive interlayer would also be acceptable.

The pane of glass 28 is preferably automotive glass and more preferably soda-lime-silica glass. The pane of glass 28 defines a thickness between 1.5 and 5.0 mm, preferably 3.1 mm. The pane of glass 28 also has a relative permittivity between 5 and 9, preferably 7. Those skilled in the art, however, realize that the nonconductive pane 26 may be formed from plastic, fiberglass, or other suitable nonconductive materials.

Figure 2:
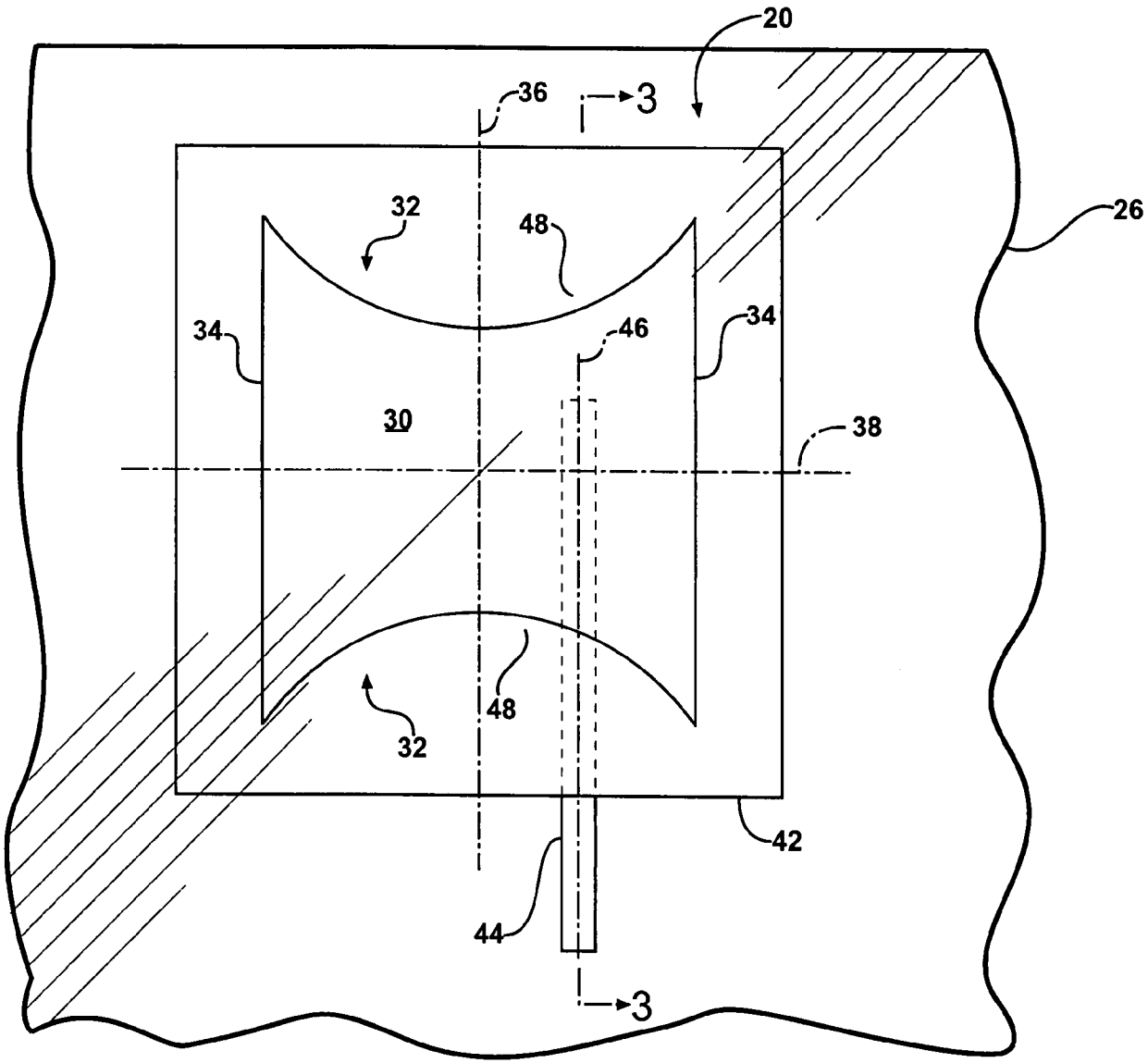
FIG. 2 is a top view of a first embodiment of the antenna showing a feed line and a patch element with a pair of radiating sides defined as circular arcs curving inward.
Figure 3:
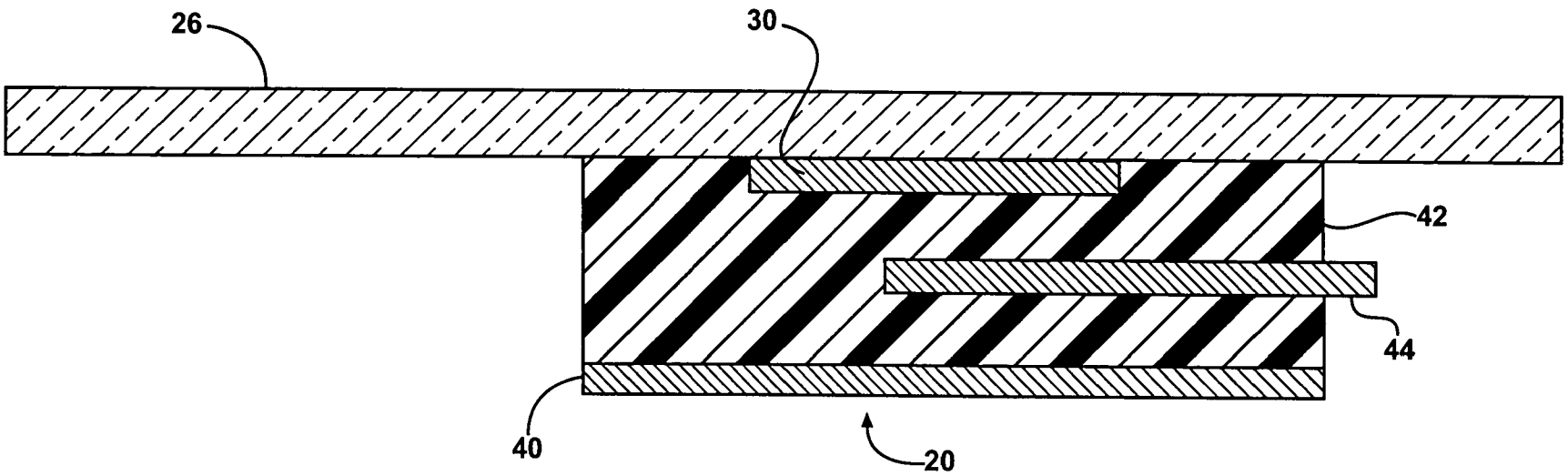
FIG. 3 is a cross-sectional side view of the first embodiment of the antenna taken along line 3-3 in FIG. 2 showing the pane of glass, the patch element, a dielectric, the feed line, and the ground plane.

Referring now to FIGS. 2 and 3, the nonconductive pane 26 functions as a radome to the antenna 20. That is, the nonconductive pane 26 protects the other components of the antenna 20, as described in detail below, from moisture, wind, dust, etc. that are present outside the vehicle 24.

The antenna 20 includes a patch element 30 formed of an electrically conductive material. The patch element 30 is preferably disposed on the nonconductive pane 26. It is also preferred that the patch element 30 comprise a silver paste as the electrically conductive material disposed directly on the nonconductive pane 26 and hardened by a firing technique known to those skilled in the art. Alternatively, the patch element 30 could comprise a flat piece of metal, such as copper or aluminum, adhered to the nonconductive pane 26 using an adhesive.

The patch element 30 includes a pair of radiating sides 32 disposed opposite each other. The radiating sides 32 are generally disposed inward to give the patch element 30 a concave shape. Disposing the radiating sides 32 inward give the patch element 30 an increased length of outer periphery over a patch element having a rectangular shape. This increased length leads to an increased effective radiation of the antenna 20. The patch element 30 also includes a pair of spacer sides 34 disposed opposite each other. The spacer sides 34 are preferably substantially straight, however, the spacer sides 34 may be curved. The radiating sides 32 preferably form an angle less than 90 degrees with the spacer sides 34. Due to this angle being less than 90 degrees, the concave shape of the antenna 20 produces minimal visual obstruction on the window 22 of the vehicle 24 to meet automaker antenna 20 size specifications.

A first axis 36 is defined through a center of the radiating sides 32. The first axis 36 is preferably substantially equidistant from each of the spacer sides 34. A second axis 38 is defined though a center of the spacer sides 34. The particular shapes, dimensions, and symmetry of the various illustrated embodiments of the patch element 30 are explained in greater detail below.

Referring now to FIG. 3, the antenna 20 further includes a ground plane 40. The ground plane 40 is disposed substantially parallel to and spaced from the patch element 30. The ground plane 40 is also formed of an electrically conductive material. It is common practice for the ground plane 40 to have an area larger than that of the patch element 30. Particularly, it is preferred that each side of the ground plane 40 measures about 40 mm. It is further preferred that the patch element 30 and the ground plane 40 are centered with respect to one another. This orientation prevents additional visual obstruction to the driver of the vehicle 24. In the illustrated embodiments, the ground plane 40 is rectangularly-shaped. However, those skilled in the art realize that the ground plane 40 may have alternative sizes and shapes.

The antenna 20 also includes a dielectric 42 sandwiched between the patch element 30 and the ground plane 40. The dielectric 42 is formed of a nonconductive material and isolates the patch element 30 from the ground plane 40. Therefore, the patch element 30 and the ground plane 40 are not electrically connected by an electrically conductive material. Those skilled in the art realize that the dielectric 42 could be a non-conductive fluid, such as air.

In the illustrated embodiments, the dielectric 42 is disposed in contact with the patch element 30 and the ground plane 40. Of course, the dielectric 42 may be sandwiched between the patch element 30 and the ground plane 40 without being in direct contact with the patch element 30 and/or the ground plane 40. Furthermore, the dielectric 42 may extend beyond the areas defined by the patch element 30 and the ground plane 40 so long as at least a portion of the dielectric 42 is between the patch element 30 and the ground plane 40.

It is preferred that the dielectric 42 have a thickness measuring about 3.0 mm. It is further preferred that the dielectric 42 has a relative permittivity of about 3.55. However, those skilled in the art realize the dielectric 42 may have other dimensions and/or a different relative permittivity. Further, the dielectric 42 may be composed of a plurality of layers or regions. The relative permittivity of each of these layers or regions may be identical to each other or may be different from each other.

The antenna 20 also includes a feed line 44 formed of an electrically conductive material and preferably disposed within the dielectric 42. The feed line 44 is a transmission device that is preferably electromagnetically coupled to the patch element 30 and the ground plane 40. The term "electromagnetically coupled", as used in the art, refers to the feed line 44 not being in direct contact with the patch element 30. In the case of the present invention, the feed line 44 runs generally parallel to the patch element 30 and the ground plane 40. However, those skilled in the art realize that the feed line 44 may be directly connected to the patch element 30, i.e., the feed line 44 may come into direct contact with the patch element 30.

The feed line 44 is disposed substantially parallel to and offset from the first axis 36. By disposing the feed line 44 offset from the first axis 36, i.e., not centered with the patch element 30, the feed line 44 provides the antenna 20 with a circular polarization radiation characteristic. As noted above, the circular polarization radiation characteristic is critical to receiving RF signals transmitted from satellites, such as those used in SDARS applications.

The feed line 44 is preferably rectangularly-shaped. Of course other shapes for the feed line 44 may alternatively be implemented. A feed line axis 46 is defined extending lengthwise along a center of the feed line 44. The feed line axis 46 is spaced, i.e., offset, between 3 and 10 mm from the first axis 36. The exact spacing is dependent on the dimensions of the patch element 30. In a first embodiment, as shown in FIG. 2, the feed line axis 46 is spaced about 6.15 mm from the first axis 36.

A width of the feed line 44 is preferably about 3 mm. This 3 mm width helps provide the antenna 20 a 50 Ω impedance to match a transmission line (not shown) connected to the feed line 44. However, the width of the feed line 44 may be varied to provide the antenna 20 with an alternative impedance. The feed line 44 also extends across the second axis 38. Preferably, for tuning purposes, the feed line 44 extends about 4.2 mm across the second axis 38. However, different lengths of extension across the second axis 38 may be contemplated depending on the particular shape of the patch element 30.

Each of the radiating sides 32 of the patch element 30 defines a length. The length of each of the radiating side 32 preferably measures about one-quarter of a wavelength λ of a desired signal. In the illustrated embodiments, the desired frequency is about 2,338 MHz, which corresponds to the center frequency used by XM® Satellite Radio. Therefore, the length of each radiating side 32 is about 32 mm. However, as stated above, the radiating sides 32 are disposed inward to give the patch element 30 a concave shape. This provides the patch element 30 a compact area that does not significantly reduce the view of a driver of the vehicle 24. Preferably, the area defined by the patch element 30 is less than 1,600 $mm^2$. More preferably, the area is less than 1,000 $mm^2$. The inward disposition of the radiating sides 32 provides the patch element 30 with a smaller area than that of a patch element 30 with a rectangular shape.

In the first embodiment, as shown in FIG. 2, each of the radiating sides 32 is further defined as a curved line segment 48. The curved line segment 48 curves inward toward the second axis 38 to provide the patch element 30 with a concave shape. The curved line segments 48 are bisected by the first axis 36 such that the patch element 30 is symmetrical with respect to the first axis 36. The curved line segments 48 of the first embodiment are further defined as arcs of a circle. The circle preferably has a radius of 20 mm. In the first embodiment, the length of the spacer sides 34 is about 32 mm and the spacer sides 34 are separated by about 24 mm.

Figure 4:
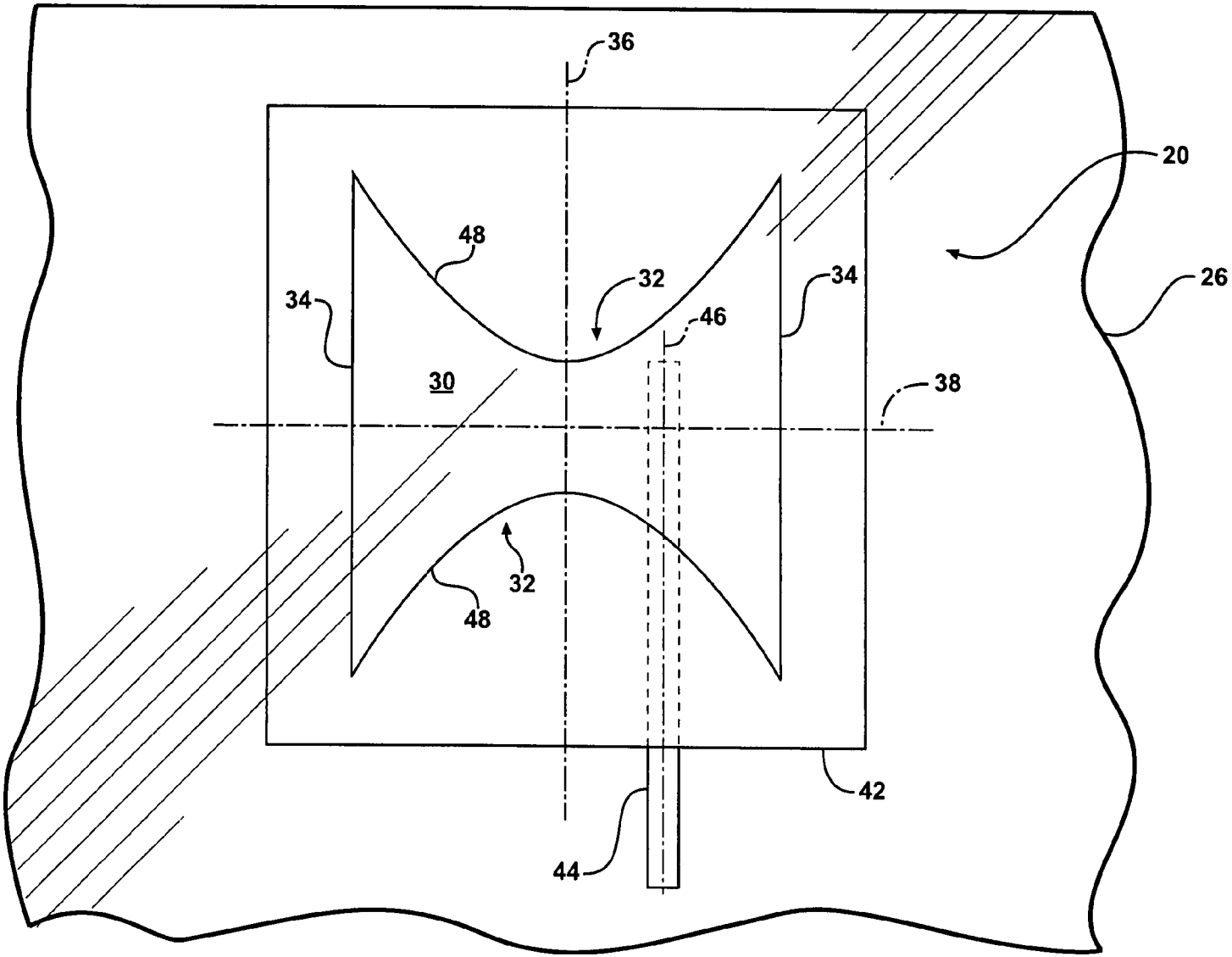
FIG. 4 is a top view of a second embodiment of the antenna showing the feed line and the patch element with the pair of radiating sides embodied as symmetrical parabolas curving inward.

Referring now to FIG. 4, in a second embodiment of the antenna 20, each of the radiating sides 32 is a curved line segment 48 having a parabolic shape. The curved line segments 48 are symmetrical with respect to the second axis 38.

Figure 5:
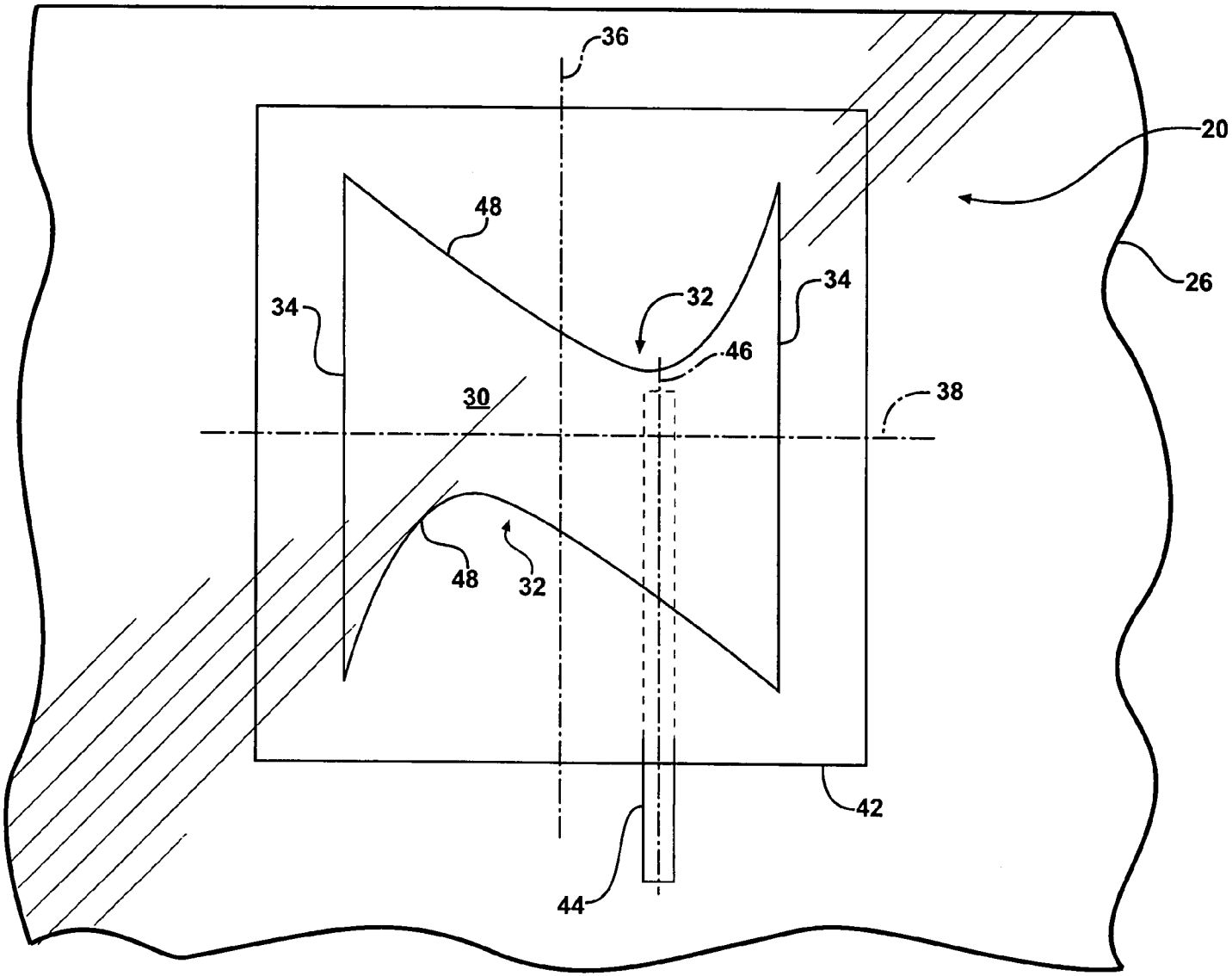
FIG. 5 is a top view of a third embodiment of the antenna showing the feed line and the patch element with the pair of radiating sides embodied as non-symmetrical parabolas curving inward.

A third embodiment of the antenna 20 is shown in FIG. 5. In the third embodiment, each of the radiating sides 32 is a curved line segment 48 having a parabolic shape. However, each curved line segments 48 are non-symmetrical with respect to the second axis 38.

Figure 6:
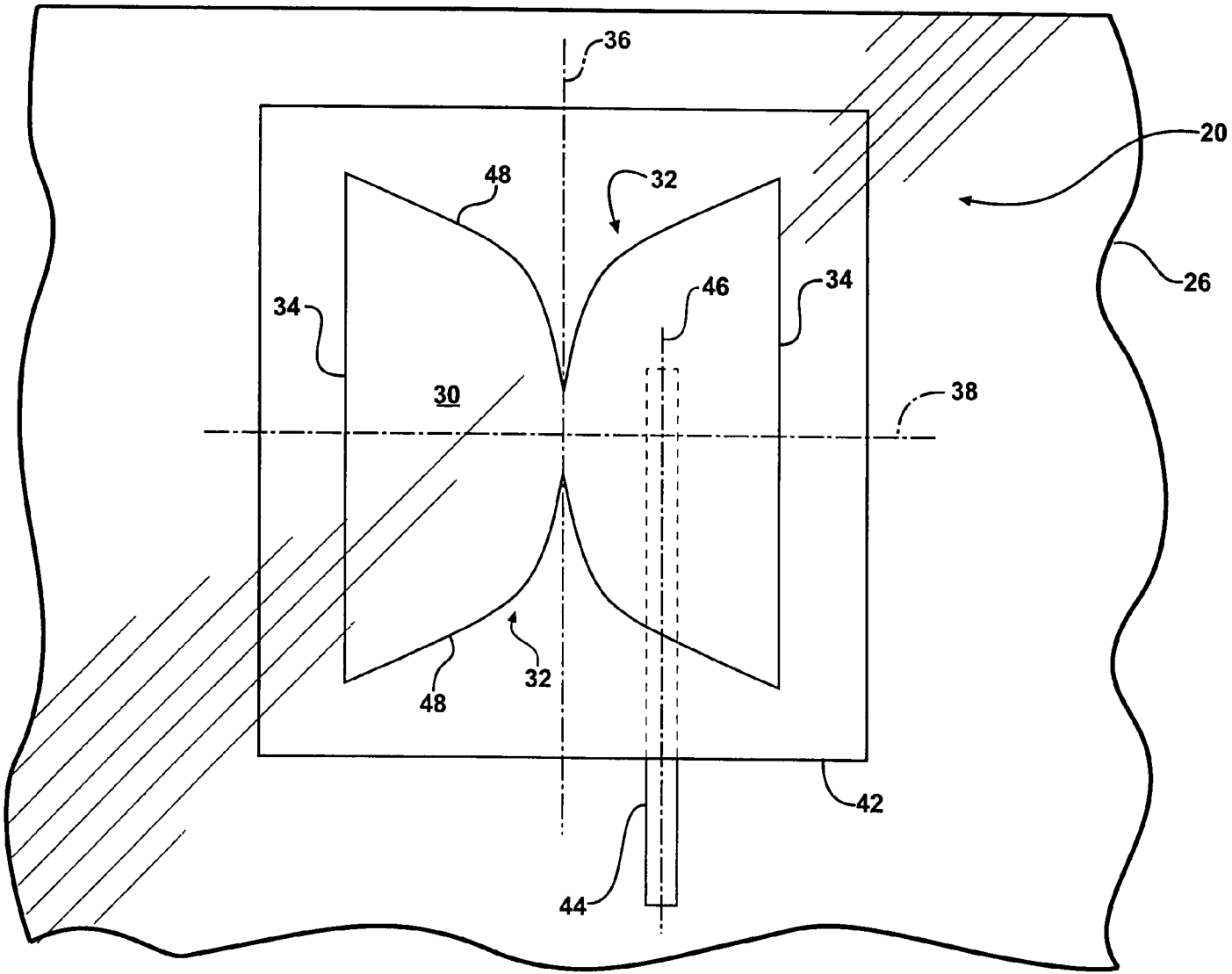
FIG. 6 is a top view of a fourth embodiment of the antenna showing the feed line and the patch element with the pair of radiating sides embodied as curved line segments.

Referring now to FIG. 6, a fourth embodiment of the antenna 20 is shown. Each of the radiating sides 32 is a curved line segment 48 providing the patch element 30 with an hourglass shape.

Figure 7:
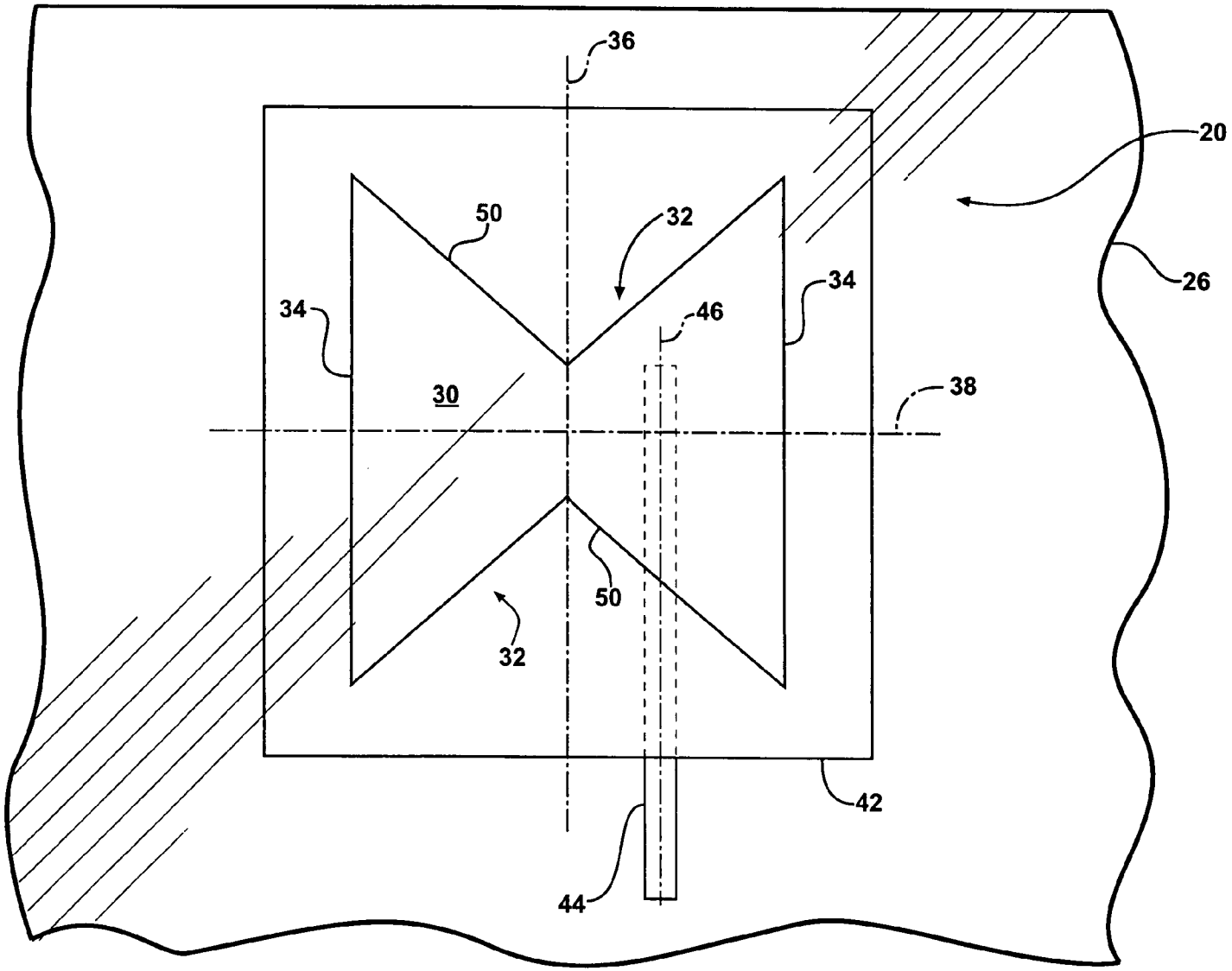
FIG. 7 is a top view of a fifth embodiment of the antenna showing the feed line and the patch element with the pair of radiating sides embodied as two straight segments.
Figure 8:
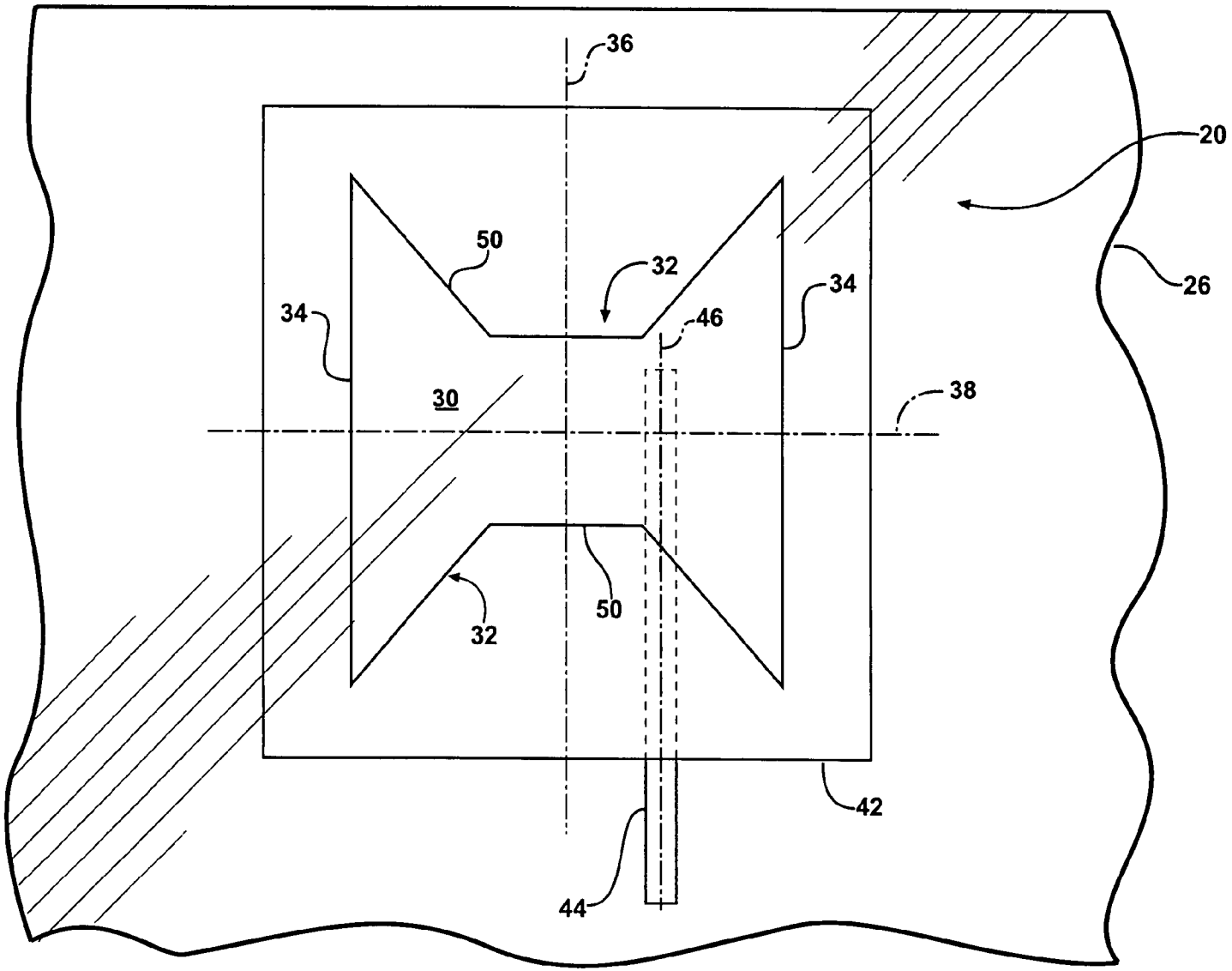
FIG. 8 is a top view of a sixth embodiment of the antenna showing the feed line and the patch element with the pair of radiating sides embodied as three straight segments.
Figure 9:
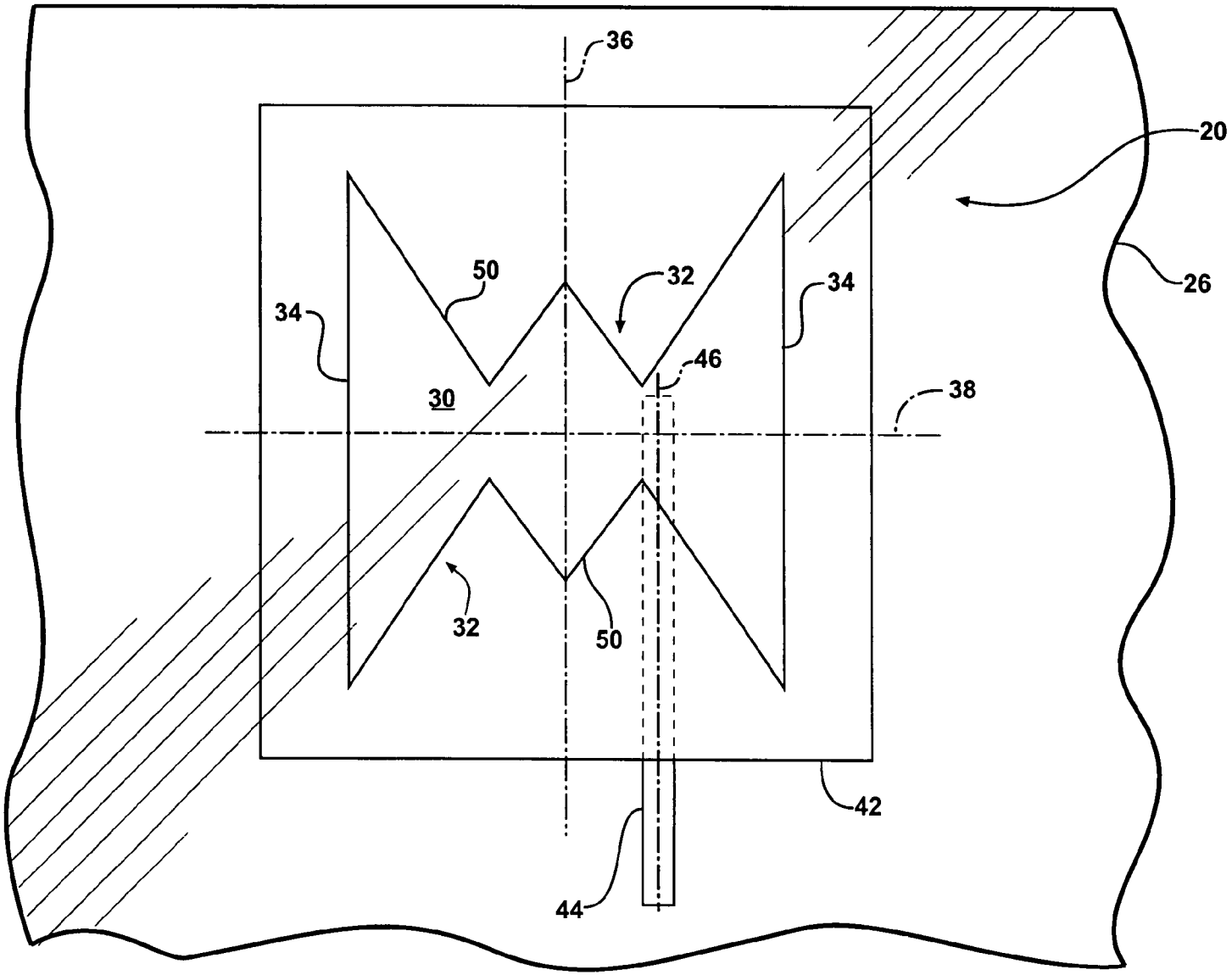
FIG. 9 is a top view of a seventh embodiment of the antenna showing the feed line and the patch element with the pair of radiating sides embodied as four straight segments.

Fifth, sixth, and seventh embodiments of the antenna 20 are shown in FIGS. 7, 8, and 9 respectively. In each of the fifth, sixth, and seventh embodiments, each of the radiating sides 32 is further defined as a plurality of straight line segments 50. The straight line segments 50 provide the patch element 30 with a concave shape. In the fifth embodiment, as shown in FIG. 7, each of the radiating sides 32 is implemented as two straight line segments 50. The two straight line segments 50 are about the same length and meet to form a right angle. Referring to FIG. 8, the sixth embodiment shows each of the radiating sides 32 implemented as three straight line segments 50. One of the three straight line segments 50 is substantially parallel to the second axis 38. The seventh embodiment is shown in FIG. 9 and includes four straight line segments 50 as each radiating side 32. The four straight line segments 50 are arranged in a "W" shape having an apex along the first axis 36.

Obviously, many modifications and variations of the present invention are possible in light of the above teachings. The invention may be practiced otherwise than as specifically described within the scope of the appended claims.

What is claimed is:

1. A window having an integrated antenna, said window comprising:

a nonconductive pane of transparent material;

a patch element formed of a conductive material and disposed on said nonconductive pane;

said patch element having a pair of radiating sides disposed opposite each other and a pair of spacer sides disposed opposite each other;

a first axis defined through a center of said radiating sides;

a second axis defined though a center of said spacer sides;

a ground plane formed of a conductive material and disposed substantially parallel to and spaced from said patch element;

a dielectric sandwiched between said patch element and said ground plane;

a feed line formed of a conductive material and disposed within said dielectric;

said feed line disposed substantially parallel to and offset from said first axis for providing said antenna with a circular polarization radiation characteristic; and wherein each of said radiating sides projects inward toward said second axis and provides said patch element with a concave shape.

2. A window as set forth in claim 1 wherein said non-conductive pane is further defined as a pane of glass.

3. A window as set forth in claim 2 wherein said pane of glass is further defined as automotive glass.

4. A window as set forth in claim 3 wherein said automotive glass is further defined as soda-lime-silica glass.

5. A window as set forth in claim 1 wherein said feed line extends across said second axis.

6. A window as set forth in claim 1 wherein said feed line is substantially parallel to said patch element and said ground plane.

7. A window as set forth in claim 1 wherein said feed line is rectangularly-shaped and defines a feed line axis extending lengthwise along a center of said feed line.

8. A window as set forth in claim 7 wherein said feed line axis is spaced between 3 and 10 mm from said first axis.

9. A window as set forth in claim 7 wherein a width of said feed line is about 3 mm.

10. A window as set forth in claim 1 wherein a length of each of said radiating sides measures about one-quarter of a wavelength λ of a desired signal.

11. A window as set forth in claim 1 wherein an area defined by said patch element is less than 1,600 mm2.

12. A window as set forth in claim 11 wherein the area defined by said patch element is less than 1,000 mm2.

13. A window as set forth in claim 1 wherein each of said radiating sides is further defined as a curved line segment curving inward toward said second axis and providing said patch element with said concave shape.

14. A window as set forth in claim 13 wherein said curved line segments are bisected by said second axis such that said patch element is symmetrical with respect to said second axis.

15. A window as set forth in claim 14 wherein said curved line segments are further defined as arcs of a circle.

16. A window as set forth in claim 14 wherein said curved line segments have a parabolic shape.

17. A window as set forth in claim 13 wherein said curved line segments are non-symmetrical with respect to said second axis.

18. A window as set forth in claim 1 wherein each of said of radiating sides is further defined as a plurality of straight line segments providing said patch element with said concave shape.

19. A window as set forth in claim 18 wherein each of said plurality of straight line segments is further defined as two straight line segments.

20. A window as set forth in claim 18 wherein each of said plurality of straight line segments if further defined as three straight line segments.

21. A window as set forth in claim 18 wherein each of said plurality of straight line segments if further defined as four straight line segments.

22. An antenna comprising:

a patch element formed of a conductive material and having a pair of radiating sides disposed opposite each other and a pair of spacer sides disposed opposite each other;

a first axis defined through a center of said radiating sides;

a second axis defined though a center of said spacer sides;

a ground plane formed of a conductive material and disposed substantially parallel to and spaced from said patch element;

a dielectric sandwiched between said patch element and said ground plane;

a feed line formed of a conductive material and disposed within said dielectric;

said feed line disposed substantially parallel to and offset from said first axis for providing said antenna with a circular polarization radiation characteristic; and wherein each of said radiating sides projects inward toward said second axis and provides said patch element with a concave shape.

23. An antenna as set forth in claim 22 wherein said feed line extends across said second axis.

24. An antenna as set forth in claim 22 wherein said feed line is disposed substantially parallel to said patch element and said ground plane.

25. An antenna as set forth in claim 22 wherein said feed line is rectangularly-shaped and defining a feed line axis extending lengthwise along a center of said feed line.

26. An antenna as set forth in claim 25 wherein said feed line axis is spaced between 3 and 10 mm from said first axis.

27. An antenna as set forth in claim 25 wherein a width of said feed line is about 3 mm.

28. An antenna as set forth in claim 22 wherein a length of each of said radiating sides measures about one-quarter of a wavelength λ of a desired signal.

29. An antenna as set forth in claim 22 wherein an area defined by said patch element is less than 1,600 $mm^2$.

30. An antenna as set forth in claim 29 wherein the area defined by said patch element is less than 1,000 $mm^2$.

31. An antenna as set forth in claim 22 wherein each of said radiating sides is further defined as a curved line segment curving inward toward said second axis and providing said patch element with said concave shape.

32. An antenna as set forth in claim 31 wherein said curved line segments are bisected by said second axis such that said patch element is symmetrical with respect to said second axis.

33. An antenna as set forth in claim 32 wherein said curved line segments are further defined as parabolic sections.

34. An antenna as set forth in claim 32 wherein said curved line segments are further defined as arcs of a circle.

35. An antenna as set forth in claim 31 wherein said curved line segments are non-symmetrical with respect to said second axis.

36. An antenna as set forth in claim 22 wherein each of said of radiating sides is further defined as a plurality of straight line segments providing said patch element with said concave shape.

37. An antenna as set forth in claim 36 wherein each of said plurality of straight line segments is further defined as two straight line segments.

38. An antenna as set forth in claim 36 wherein each of said plurality of straight line segments if further defined as three straight line segments.

39. An antenna as set forth in claim 36 wherein each of said plurality of straight line segments if further defined as four straight line segments.

40. An antenna comprising:

a patch element formed of a conductive material and having a pair of radiating sides disposed opposite each other and a pair of spacer sides disposed opposite each other wherein said radiating sides form an angle less than 90 degrees with said spacer sides;

a ground plane formed of a conductive material and disposed substantially parallel to and spaced from said patch element;

a dielectric sandwiched between said patch element and said ground plane; and a single feed line formed of a conductive material and disposed within said dielectric between said patch element and said ground plane and substantially parallel to said patch element for providing said antenna with a circular polarization radiation characteristic.

* * * * *

UNITED STATES PATENT AND TRADEMARK OFFICE

CERTIFICATE OF CORRECTION

PATENT NO. : 7,333,059 B2
APPLICATION NO. : 11/190445
DATED : February 19, 2008
INVENTOR(S) : Qian Li et al.

It is certified that error appears in the above-identified patent and that said Letters Patent is hereby corrected as shown below:

Column 7, line 57, claim 20, after segments delete “if”, and insert therein --is--

Column 7, line 60, claim 21, after segments delete “if”, and insert therein --is--

Column 8, line 59, claim 38, after segments delete “if”, and insert therein --is--

Column 8, line 62, claim 39, after segments delete “if”, and insert therein --is--

Signed and Sealed this

Twenty-sixth Day of August, 2008

JON W. DUDAS
*Director of the United States Patent and Trademark Office*